US007007522B1

(12) United States Patent
Lee

(10) Patent No.: US 7,007,522 B1
(45) Date of Patent: Mar. 7, 2006

(54) LOCK

(76) Inventor: Fu-An Lee, No.58, Lioujhih Lane, Lioufen Rd., Lioufen Village, Waipu Township, Taichung County 43857 (TW)

( * ) Notice: Subject to any disclaimer, the term of this patent is extended or adjusted under 35 U.S.C. 154(b) by 0 days.

(21) Appl. No.: 11/137,497

(22) Filed: May 26, 2005

(51) Int. Cl.
*E05B 27/08* (2006.01)

(52) U.S. Cl. ..... 70/43; 70/209; 70/379 R; 70/419; 70/420; 70/423; 70/453; 70/491

(58) Field of Classification Search ..... 70/43, 70/379 R, 379 A, 423, 424, 427, 428, 419, 70/209, 420, 403, 404, 453, 454, 491
See application file for complete search history.

(56) References Cited

U.S. PATENT DOCUMENTS

| | | | | | |
|---|---|---|---|---|---|
| 41,177 | A | * | 1/1864 | Harold | 70/491 |
| 1,499,211 | A | * | 6/1924 | Giralico | 70/423 |
| 1,766,784 | A | * | 8/1930 | Gregory | 70/43 |
| 1,804,955 | A | * | 5/1931 | Schlumpf | 70/346 |
| 2,098,249 | A | * | 11/1937 | Kistner | 70/141 |
| 2,993,361 | A | * | 7/1961 | Lahr | 70/491 |
| 3,343,386 | A | * | 9/1967 | Hall | 70/423 |
| 3,380,268 | A | * | 4/1968 | Knox | 70/491 |
| 3,444,712 | A | * | 5/1969 | Greenwald | 70/423 |
| 3,465,556 | A | * | 9/1969 | McIlvenny | 70/423 |
| 3,903,720 | A | * | 9/1975 | Scherbing | 70/491 |
| 3,903,721 | A | * | 9/1975 | Aaron | 70/423 |
| 4,006,615 | A | * | 2/1977 | Szova | 70/491 |
| 4,104,898 | A | * | 8/1978 | Fois | 70/419 |
| 4,996,856 | A | * | 3/1991 | Lin et al. | 70/359 |
| 5,819,569 | A | * | 10/1998 | Herdman | 70/420 |

* cited by examiner

*Primary Examiner*—Lloyd A. Gall
(74) *Attorney, Agent, or Firm*—Bacon & Thomas, PLLC

(57) ABSTRACT

A lock includes a body defining a first bore having a lock core mounted therein, and a second bore having an engaging element inserted thereinto; and a front barrier shield fixedly mounted in the body in front of the lock core. A communicating hole is formed in the body behind the lock core to communicate the two bores. A locking pin is disposed in the communicating hole to move into or out of a locking hole formed on the engaging element under control of the lock core, so as to lock or release the engaging element to or from the body, respectively. The front barrier shield includes a plurality of axially spaced and staggered barrier sheets to define a zigzag keyway, preventing a thief from peeping through the first bore and destructing the lock core.

7 Claims, 7 Drawing Sheets

LOCK

FIELD OF THE INVENTION

The present invention relates to a lock for automobiles and motorcycles, and more particularly to a lock that includes a lock core durable for use without producing error, and has a structure adapted to prevent the lock from being arbitrarily opened by forcibly knocking off an engaging element thereof, and is provided with a front barrier shield to prevent a thief from peeping into and destructing an internal structure of the lock.

BACKGROUND OF THE INVENTION

Different types of locks are widely used in our daily life for securely locking various kinds of items, such as doors, windows, cabinets, etc. Most locks include a body and an engaging element removably connected to the body for locking an item between the body and the engaging element. The body is internally provided with elastically movable latches for engaging with locking holes on the engaging element and thereby locking the engaging element to the body. The latches are normally pushed by springs to a locked position, so that the lock is in a locked state and can be opened only with a corresponding key.

The locks are usually differently shaped according to their usages and functions. There are locks developed for locking a wheel of a motorcycle, the steering wheel or the gearshift of an automobile, etc. These locks having different appearances usually have similar internal structural design and therefore all have the following disadvantages in use:

1. The latches are subjected to wearing and errors when the lock has been used over a long time, making it difficult to successfully open the lock with the corresponding key.
2. The latches are pushed by springs to the locked position, so that the engaging element is locked to the body of the lock. However, the engaging element can be forcibly knocked off the body to open the lock, even if the latches are in the locked position.
3. The keyhole on the body of the lock is exposed to the external environment without any protective shield. A thief may easily peep through the keyhole to find out and destruct an internal structure of the lock. It is therefore tried by the inventor to develop an improved lock to eliminate the drawbacks existed in the conventional locks.

SUMMARY OF THE INVENTION

A primary object of the present invention is to provide a lock that could not be arbitrarily opened by forcibly knocking an engaging element off a body of the lock.

Another object of the present invention is to provide a lock that includes a front barrier shield mounted in a front end of a body of the lock, so that a thief could not peep through the front barrier shield to find out the internal structure of the lock.

A further object of the present invention is to provide a lock that includes a lock core having a plurality of axially extended collared pins provided thereon. The collared pins can be differently arrayed to form different lock cores, and are not subjected to wearing or error when the lock has been used over a long time, enabling the lock to be always successfully opened with a corresponding key.

To achieve the above and other objects, the lock according to the present invention includes a body defining two bores, one of which has a lock core mounted therein, and the other one of which has an engaging element associated therewith; and a front barrier shield fixedly mounted in the body in front of the lock core. A communicating hole is formed in the body behind the lock core to communicate the two bores with each other. A locking pin is disposed in the communicating hole to move into or out of a locking hole formed on the engaging element under control of the lock core, so as to lock or release the engaging element to or from the body, respectively. With this structure, the engaging element could not be forcibly knocked off the body to open the lock. The front barrier shield includes a plurality of axially spaced and staggered barrier sheets to define a zigzag keyway in front of the lock core, preventing a thief from peeping through the zigzag keyway to damaging the lock.

BRIEF DESCRIPTION OF THE DRAWINGS

The structure and the technical means adopted by the present invention to achieve the above and other objects can be best understood by referring to the following detailed description of the preferred embodiments and the accompanying drawings, wherein.

DETAILED DESCRIPTION OF THE PREFERRED EMBODIMENTS

Figure 1:
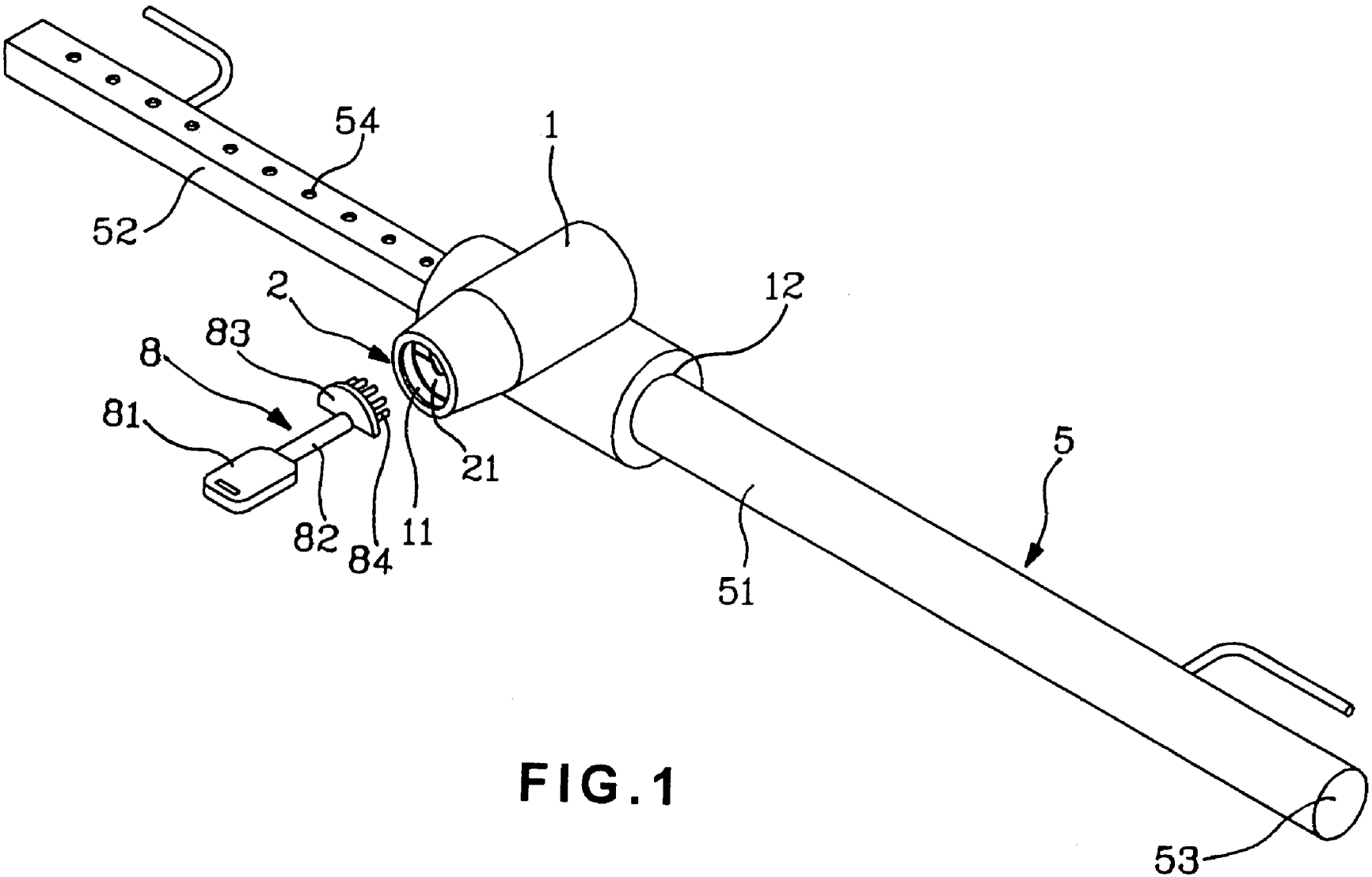
FIG. 1 is an assembled perspective view of a lock according to a first embodiment of the present invention.
Figure 2:
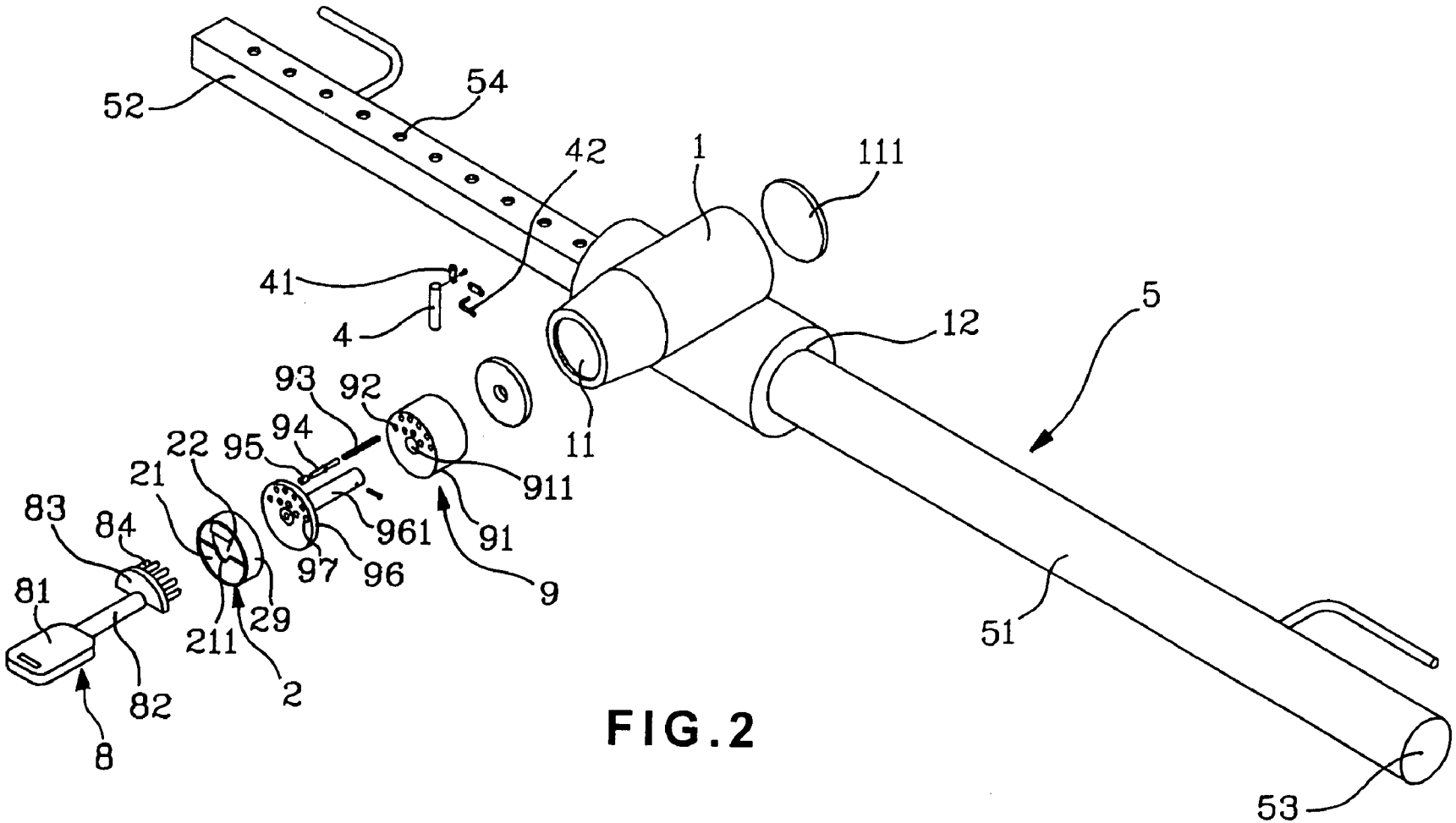
FIG. 2 is a partially exploded perspective view of the lock of FIG. 1.
Figure 3:
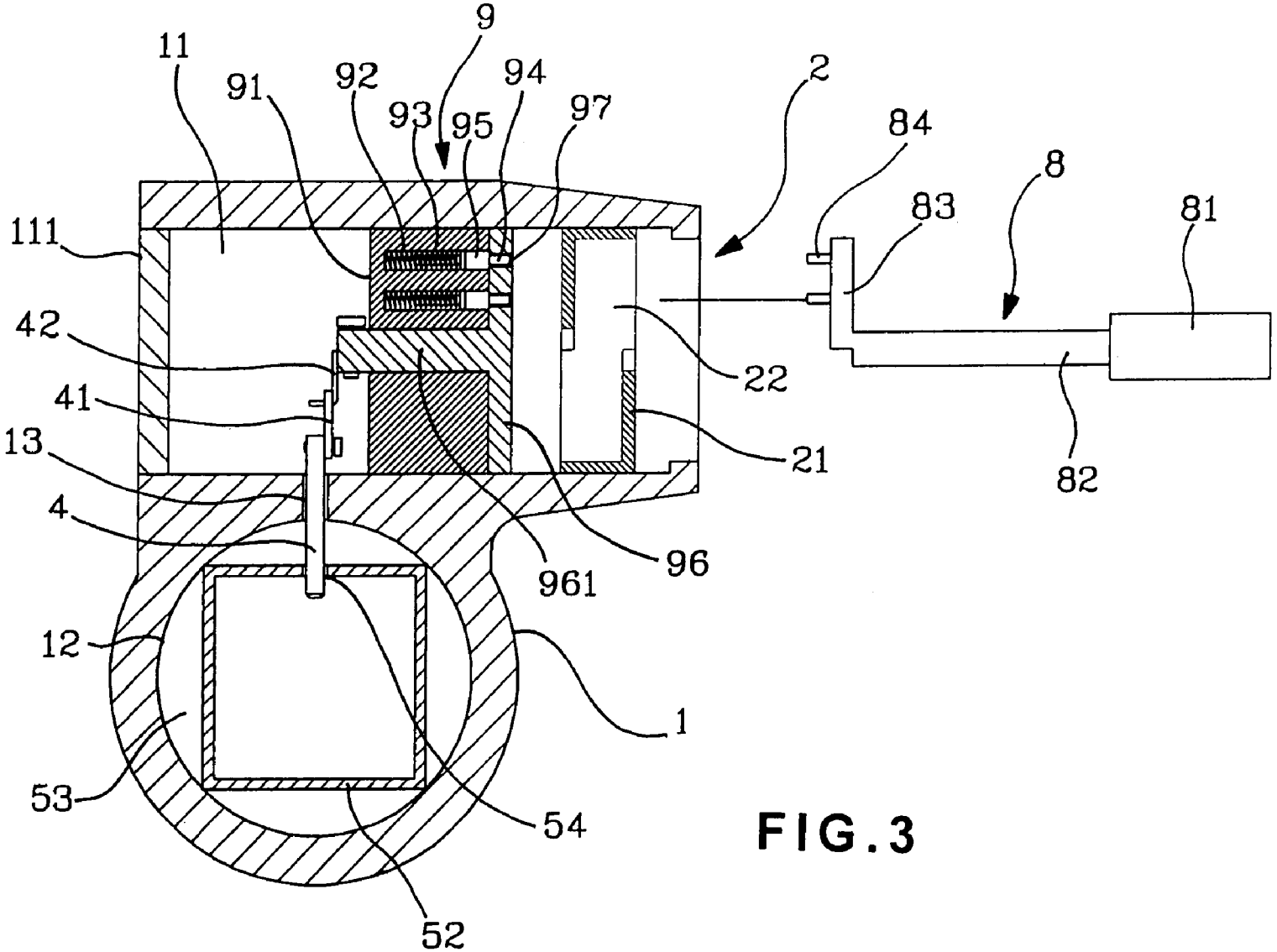
FIG. 3 is an assembled sectional view of the lock of FIG. 1.

Please refer to FIGS. 1 and 2 that are assembled and partially exploded perspective views, respectively, of a lock according to a first embodiment of the present invention, and to FIG. 3 that is an assembled sectional view of the lock of FIG. 1. As shown, the lock according to the first embodiment of the present invention mainly includes a body 1 and a front barrier shield 2.

The body 1 defines a first bore 11 having a lock core 9 mounted therein, and a second bore 12 having an engaging element 5 inserted thereinto. The first and the second bore 11, 12 are communicated with each other via a communicating hole 13 located behind the lock core 9. A locking pin 4 is disposed in the communicating hole 13 with a first end connected to and thereby moving along with the lock core 9. It is noted the locking pin 4 is not driven to move via any elastic element.

The front barrier shield 2 is mounted in the first bore 11 in front of the lock core 9, and consists of a plurality of axially spaced and staggered barrier sheets 21 to define a zigzag keyway 22 in the front barrier shield 2.

As can be seen from FIG. 2, the front barrier shield 2, the lock core 9, and the locking pin 4 sequentially constitute front, middle, and rear sections of a locking mechanism of the lock of the present invention.

The lock core 9 includes a seat 91 having a plurality of axially extended long holes 92 provided thereon, a plurality of springs 93 and a plurality of collared pins 94 separately mounted in the long holes 92, a seal ring 95 mounted on a front end of each collared pin 94 to allow only a predetermined length of the collared pin 94 to forward project from the seal ring 95, and a rotating plate 96 rotatably connected to a front end of the seat 91 through engagement of a central shaft 961 rearward extended from the rotating plate 96 with a shaft hole 911 axially formed on the seat 91. The rotating plate 96 is formed of a plurality of through holes 97 corresponding to the long holes 92 on the seat 91. The rotating plate 96 is connected to the front end of the seat 91 with the through holes 97 aligned with the long holes 92, so that the length of each collared pin 94 forward projected from the seal ring 95 is normally pushed by the spring 93 to elastically extend into one corresponding through hole 97 on the rotating plate 96, preventing the rotating plate 96 from rotating relative to the seat 91 and thereby restricting the lock to a locked state.

The first end of the locking pin 4 is indirectly connected via a link 41 and a crank 42 to a rear end of the central shaft 961 of the rotating plate 96 rearward projected from the seat 91. The link 41 has an end pivotally connected to the first end of the locking pin 4, and an opposite end pivotally connected to one arm of the crank 42, which is pivotally connected at the other arm to the central shaft 961 of the rotating plate 96. A second end of the locking pin 4 opposite to the first end is extended through the communicating hole 13 into the second bore 12 to removably engage with one of many locking holes 54 on the engaging element 5. When the rotating plate 96 is rotated, the central shaft 961 rotates synchronously to bring the crank 42 and the link 41 to move in a circular motion and thereby axially move the locking pin 4 in the communicating hole 13.

In the first embodiment of the present invention, the front barrier shield 2 includes two axially spaced semicircular barrier sheets 21, which are welded along respective circumferential edge to an inner wall surface of a short cylindrical sleeve 29, so as to separately locate at an upper and a lower position in the cylindrical sleeve 29, and are provided on respective straight edge with a centered semicircular notch 211 each.

To assemble the locking mechanism to the body 1, first fixedly mount the lock core 9 in the first bore 11 near a middle section thereof, then fixedly weld the short cylindrical sleeve 29 having the two semicircular barrier sheets 21 welded thereto to an inner front end of the first bore 11. Thereafter, insert the locking pin 4 into the communicating hole 13 and pivotally connect the first end of the locking pin 4 to the central shaft 961 of the rotating plate 96 of the lock core 9 via the link 41 and the crank 42. Finally, seal a rear open end of the first bore 11 by way of welding a cover 111 to the rear end.

The front barrier shield 2 blocks a front open end of the first bore 11, preventing a thief from peeping through the zigzag keyway 22 to find out an internal structure of the lock, and therefore protecting the lock against breaking by the thief from an outer side thereof. To open the lock of the present invention, a key 8 specially designed corresponding to the lock must be used.

Figure 7B:
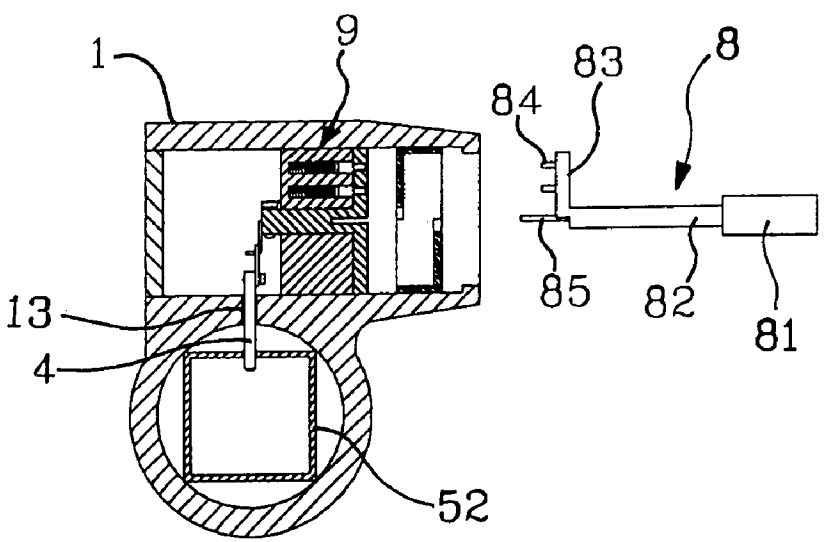
FIGS. 7A–7B shows two different embodiments of the key for the lock of the present invention.
Figure 7A:
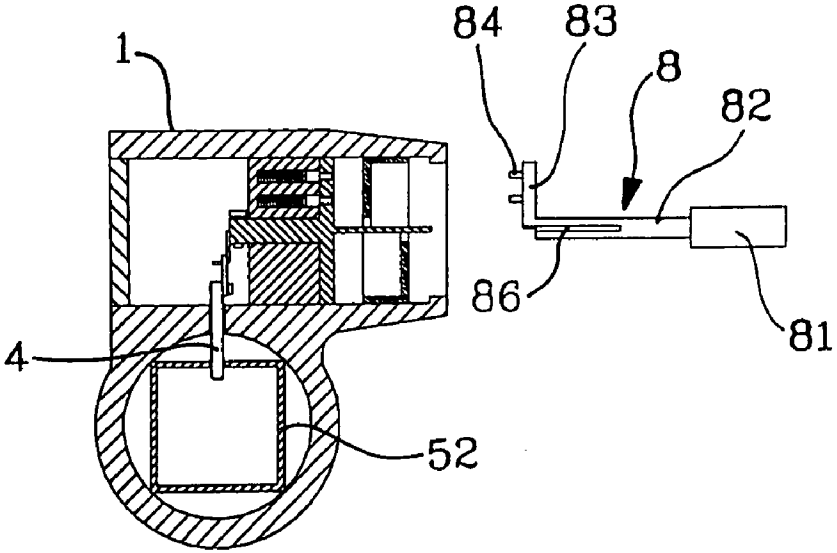

As can be seen from FIGS. 1 to 3, the key 8 includes a rear portion in the form of a flat and transversely expanded grip 81, a middle portion in the form of a round shaft 82, and a front portion in the form of a semicircular plate 83 perpendicular to the round shaft 82 with. The semicircular plate 83 is provided on a front surface with a plurality of forward extended short bars 84, which are arranged in a pattern corresponding to the through holes 97 on the rotating plate 96 and the long holes 92 on the seat 91 of the lock core 9, so that each of the short bars 84 is adapted to push against one collared pin 94 in a corresponding through hole 97. And, the semicircular plate 83 is integrally connected at a central section of a diameter thereof to the middle round shaft 82. Please refer to FIG. 7, in which two further embodiments of the key 8 are shown. In an embodiment shown at a right side of FIG. 7, the middle shaft portion 82 is provided at a front end thereof with a forward extended pin 85 for inserting into and engaging with a pin hole correspondingly formed on the rotating plate 96 and the central shaft 961. In another embodiment shown at a left side of FIG. 7, the middle shaft portion 82 is provided at a front end with an axial hole 86 for receiving and engaging with a pin forward extended from the rotating plate 96 of the lock core 9.

Figure 4C:
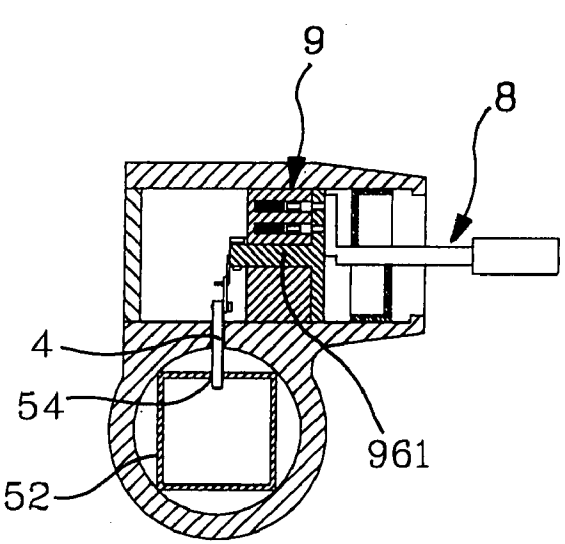
FIGS. 4A–4C shows the steps of inserting a corresponding key into the lock of FIG. 1.
Figure 4B:
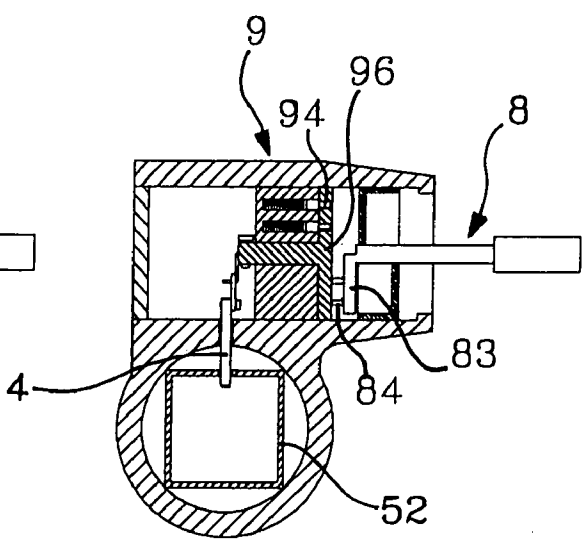
Figure 4A:
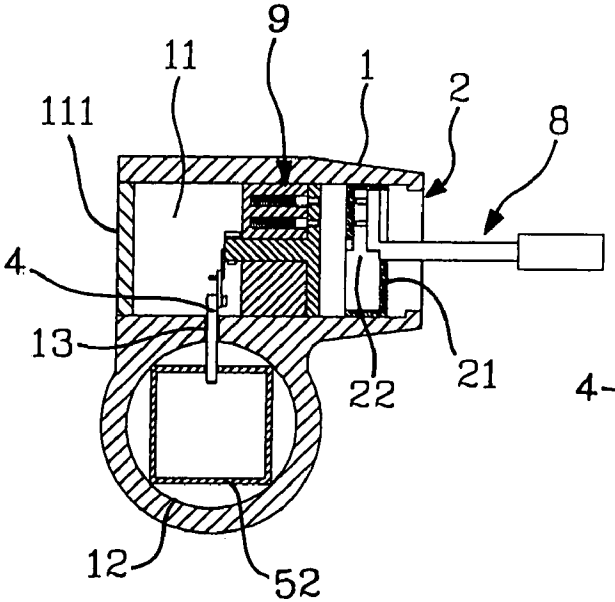
Figure 5B:
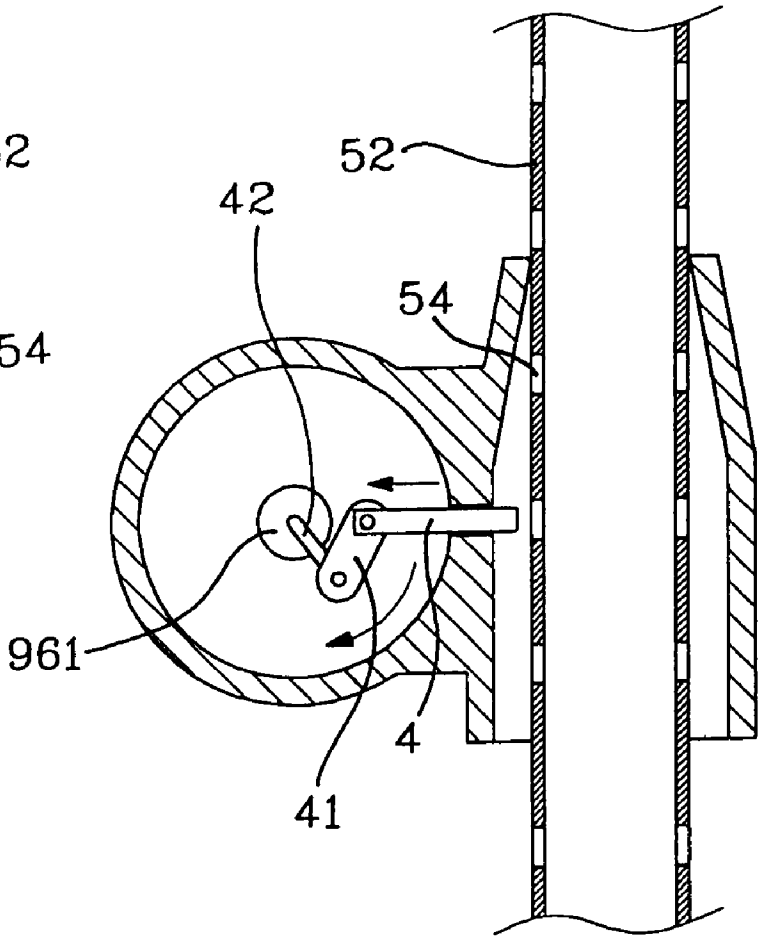
FIGS. 5A–5B is an enlarged view showing the steps of opening the lock of FIG. 1.
Figure 5A:
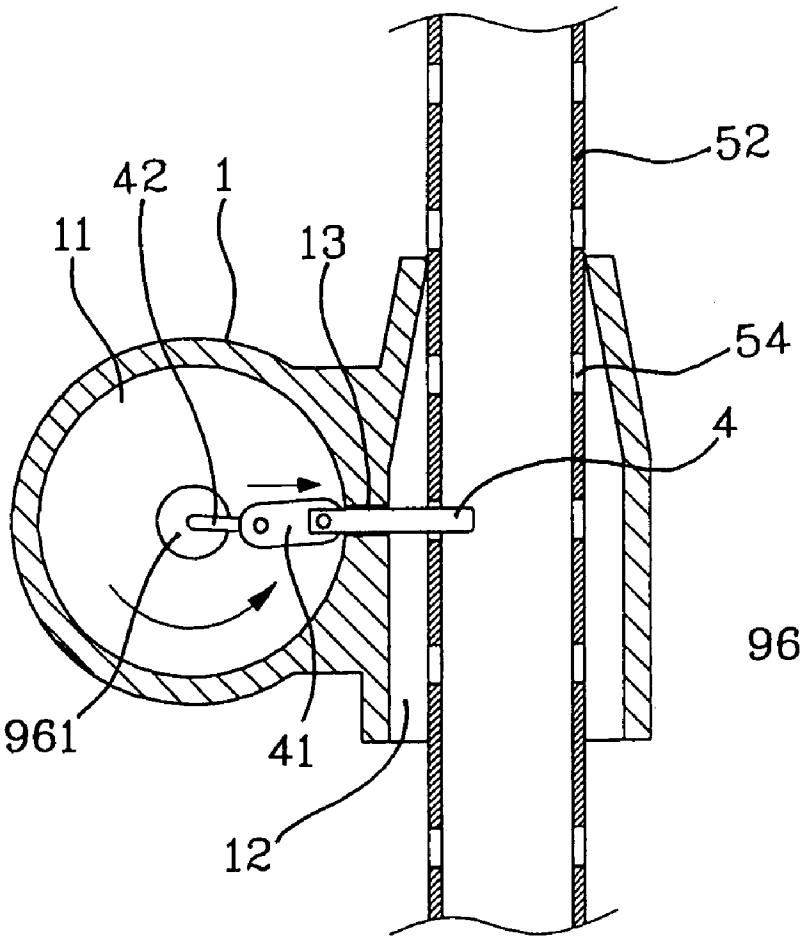

FIG. 4 shows the steps of opening the lock of the present invention using the special key 8. To open the lock, first align the semicircular front plate 83 with an empty position adjacent to the first semicircular barrier sheet 21 of the front barrier shield 2, and then insert the key 8 until the short bars 84 on the semicircular front plate 83 contact with the second semicircular barrier sheet 21 behind the empty position, as shown in the left side of FIG. 4. Then, turn the key 8 in the zigzag keyway 22 to locate the semicircular front plate 83 behind the first barrier sheet 21, and insert the key 8 further until the short bars 84 on the semicircular front plate 83 contact with the rotating plate 96 of the lock core 9, as shown in the middle of FIG. 4. Finally, turn the key 8 again until the short bars 84 on the semicircular front plate 83 are aligned with the through holes 97 on the rotating plate 96, and then insert the key 8 further, as shown in the right side of FIG. 4. At this point, the short bars 84 on the fully inserted key 8 push the collared pins 94 backward to move out of the through holes 97 and into the seat 95 of the lock core 9, allowing the key 8 to turn the rotating plate 96 relative to the seat 95. Please refer to FIG. 5. When the rotating plate 96 is turned, the central shaft 961 is rotated at the same time to bring the crank 42 and the link 41 to move in a circular motion, which causes the locking pin 4 to axially move in the communicating hole 13.

The first embodiment of the lock shown in FIG. 1 is a lock for locking a steering wheel of a vehicle. In this case, the engaging element 5 includes a first bar portion 51, which has a predetermined length and is externally provided at a predetermined position with an L-shaped hook; and a second bar portion 52, which has a length shorter than that of the first bar portion 51, and is externally provided at a predetermined position with another L-shaped hook opposite to the L-shaped hook on the first bar portion 51. The second bar portion 52 is axially movably received in the first bar portion 51 to change an overall length of the engaging element 5. A plurality of locking holes 54 are formed on one side of the second bar portion 52 facing toward the communicating hole 13. When the lock is in a locked state, the locking pin 4 is extended into one of the locking holes 54, as shown in the left side of FIG. 5. When the key 8 is inserted into the lock and turn the central shaft 961 of the lock core 9, the locking pin 4 is brought by the rotating central shaft 961 via the link 41 and the crank 42 to axially move in the communicating hole 13 out of the locking hole 54, as shown in the right side of FIG. 5. An outer end of the first bar portion 51 is formed into a hollow receiving hole 53.

Figure 6:
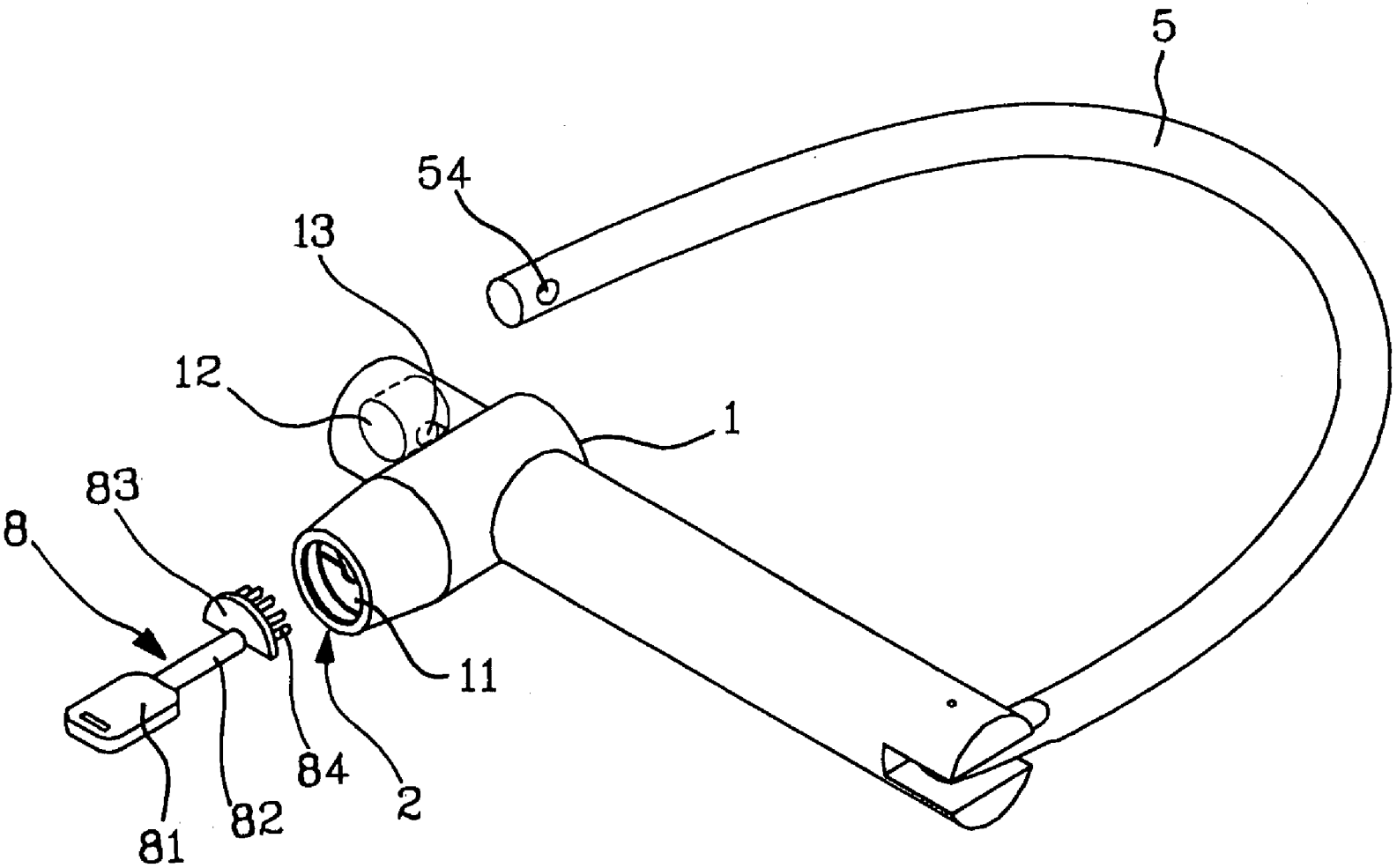
FIG. 6 is a perspective view of a lock according to a second embodiment of the present invention.

FIG. 6 shows a second embodiment of the lock of the present invention for locking a wheel of a motorcycle. In this case, the engaging element 5 is in the form of a U-shaped shackle, and the body 1 has one lateral side with an extended length, so that an end of the shackle 5 is pivotally connected to a slotted free end of the extended side. As in the first embodiment, a communicating hole 13 is formed in the body 1 to communicate the first bore 11 with the second bore 12. A free end of the shackle 5 for inserting into the second bore 12 is provided at a predetermined position with a locking hole 54, which is aligned with the communicating hole 13 when the free end of the shackle 5 has been fully inserted into the second bore 12, such that the locking pin 4 is extended into the locking hole 54 via the communicating hole 13 when the lock is in a locked state.

The following are some advantages of the lock of the present invention:

1. The front barrier shield 2 stops a thief from peeping through the zigzag keyway 22 of the lock or easily accessing and destructing the lock core 9.
2. The lock function is achieved through alignment of the collared pins 94 on the seat 91 of the lock core 9 with the through holes 97 on the rotating plate 96 of the lock core 9, enabling the lock core 9 to have simplified structure. Thousands of different arrangements of the collared pins 94 and the corresponding through holes 97 may be easily achieved simply by changing a distance between two adjacent collared pins 94, therefore thousands of different lock cores 9 may be formed. Since the collared pins 94 are axially moved in the long holes 92 on the seat 91, they are not subjected to wear or damage easily, allowing the lock to have prolonged usable life.
3. The locking pin 4 is not driven by a spring, and is therefore not easily released from the locking hole 54 on the engaging element 5 due to an external knocking force against the engaging element 5.

The present invention has been described with some preferred embodiments thereof and it is understood that many changes and modifications in the described embodiments can be carried out without departing from the scope and the spirit of the invention that is intended to be limited only by the appended claims.

What is claimed is:

1. A lock, comprising:

a body defining a first bore having a lock core mounted therein, and a second bore having an engaging element inserted thereinto; said first and said second bore being communicated with each other via a communicating hole, said communicating hole being located behind said lock core and having a locking pin axially movably disposed therein; said engaging element being provided with at least one locking hole, said locking pin being controlled by said locking core to move into said locking hole on said engaging element to thereby lock said engaging element to said second bore of said body, or move out of said locking hole on said engaging element to thereby release said engaging element from said second bore of said body; and a front barrier shield being mounted in said first bore in front of said lock core, and including a plurality of axially spaced and staggered barrier sheets to define a zigzag keyway;

said lock core including a seat and a rotating plate; said seat having a plurality of axially extended long holes provided thereon, each of said long holes having a spring and a collared pin mounted therein, a seal ring being mounted on a front end of each said collared pin to allow only a predetermined length of said collared pin to forward project from said seal ring; and said rotating plate being rotatably connected to a front end of said seat through engagement of a central shaft rearward extended from said rotating plate with a shaft hole axially formed on said seat; said rotating plate being formed of a plurality of through holes corresponding to said long holes on said seat; said rotating plate being connected to the front end of said seat with said through holes aligned with said long holes, so that the length of each said collared pin forward projected from said seal ring is normally pushed by said spring to elastically extend into a corresponding one of said through holes on said rotating plate, preventing said rotating plate from rotating relative to said seat; and said locking pin having a first end indirectly pivotally connected to said central shaft of said rotating plate via a link and a crank, and a second end extended through said communicating hole into said second bore;

whereby when said central shaft is rotated to bring said crank and said link to move in a circular motion, said locking pin is caused to axially move in said communicating hole into or out of said locking hole on said engaging element.

2. The lock as claimed in claim 1, wherein said a plurality of barrier sheets of said front barrier shield include two axially spaced semicircular barrier sheets that are welded along respective circumferential edge to an inner wall surface of a short cylindrical sleeve so as to separately locate at an upper and a lower position in said cylindrical sleeve, and are provided on respective straight edge with a centered semicircular notch each.

3. The lock as claimed in claim 1, wherein said lock is locked or opened with a specially designed key; said key including a rear portion in the form of a flat and transversely expanded grip, a middle portion in the form of a round shaft, and a front portion in the form of a semicircular plate perpendicular to said round shaft; said semicircular plate being provided on a front surface with a plurality of forward extended short bars, which are arranged in a pattern corresponding to said through holes on said rotating plate and said long holes on said seat of said lock core, and being integrally connected at a central section of a diameter thereof to said middle shaft portion.

4. The lock as claimed in claim 3, wherein said middle shaft portion of said key is provided at a front end with a forward extended pin for inserting into and engaging with a pin hole correspondingly formed on said rotating plate and said central shaft.

5. The lock as claimed in claim 3, wherein said middle shaft portion of said key is provided at a front end with an axial hole for receiving and engaging with a pin forward extended from said rotating plate of said lock core.

6. The lock as claimed in claim 1, wherein said lock is used to lock a vehicle, and said engaging element includes a first bar portion, which has a predetermined length and is externally provided at a predetermined position with an L-shaped hook, and has a free end formed into a hollow receiving hole; and a second bar portion, which has a length shorter than that of said first bar portion, and is externally provided at a predetermined position with another L-shaped hook opposite to said L-shaped hook on said first bar portion; said second bar portion being axially movably received in said first bar portion to change an overall length of said engaging element; and a plurality of locking holes being formed on one side of said second bar portion facing toward said communicating hole.

7. The lock as claimed in claim 1, wherein said lock is used to lock a motorcycle, and said engaging element is a U-shaped shackle having two ends, and said body having one lateral side with an extended length; said shackle being pivotally connected at a first end to a slotted free end of said extended lateral side of said body; a second end of said shackle being formed with one said locking hole and removably inserted into said second bore on said body with said locking hole aligned with said communicating hole for said locking pin to extend into said locking hole.

* * * * *